United States Patent [19]

Baba

[11] Patent Number: 4,693,361

[45] Date of Patent: Sep. 15, 1987

[54] TRANSFER PRESS

[75] Inventor: Kiyokazu Baba, Komatsu, Japan

[73] Assignee: Kabushiki Kaisha Komatsu Seisakusho, Tokyo, Japan

[21] Appl. No.: 538,883

[22] Filed: Oct. 4, 1983

[30] Foreign Application Priority Data

Oct. 5, 1982 [JP] Japan ..... 57-150493[U]
Oct. 5, 1982 [JP] Japan ..... 57-150494[U]
Oct. 5, 1982 [JP] Japan ..... 57-150495[U]

[51] Int. Cl.[4] ..... B65G 25/00

[52] U.S. Cl. ..... 198/621; 72/405; 198/774

[58] Field of Search ..... 414/222, 225, 226; 83/405, 255, 277, 409, 278; 198/621, 774; 100/207; 72/405

[56] References Cited

U.S. PATENT DOCUMENTS 3,456,814 7/1969 Bautz ..... 198/621
3,779,155 12/1973 Ohno ..... 100/208 X
3,834,213 9/1974 Henzler et al. ..... 414/225 X
3,977,535 8/1976 Husges et al. ..... 414/751
4,503,969 3/1985 Baba ..... 414/225 X
4,557,370 12/1985 Tanaka ..... 198/774

*Primary Examiner*—Joseph E. Valenza
*Assistant Examiner*—Donald W. Underwood
*Attorney, Agent, or Firm*—Armstrong, Nikaido, Marmelstein & Kubovcik

[57] ABSTRACT

A transfer press having workpiece gripping finger units and workpiece rests both respectively mounted in workpiece carrying -in and -out portions and idle stations defined between adjacent moving bolsters. Each of the finger units is mounted turnably up and down on central transfer bars movable into and out from the press body together with the moving bolsters without interfering with uprights of the press. Each of the workpiece rests is mounted turnably crosswise and lengthwise on the respective end faces of the individual moving bolsters on the side of conveyance of workpiece. Thus, when the moving bolsters are moved into and out from the press body, both the finger units and the workpiece rests can be automatically turned to their respective positions where they do not interfere with the uprights so that replacement of fingers and rest arms can be made readily and safely in a short time.

11 Claims, 3 Drawing Figures

1
2
3
4
5
51
52
53
54
55
15
TD 3
4
5
6
7
8
9
10
10a
11
12
12a
15
16
17
18
18a
19
19a
52
53
54
W

TRANSFER PRESS

BACKGROUND OF THE INVENTION

1. Field of the Invention

This invention relatas to a transfer press, and more particularly to a transfer press in which when moving bolsters are moved into and out from the press body, a finger unit and a workpiece rest are automatically moved to their respective positions where they do not interfere with uprights of the press.

2. Description of the prior art

In the conventional transfer press, such as shown and described in U.S. Pat. Nos. 3,779,155 and 4,503,969, there are provided a plurality of workpiece conveying transfer bars divided into plural pieces in the direction from a workpiece carring-in portion to a workpiece carrying-out portion. Out of these transfer bars, the transfer bars disposed above the moving bolsters are arranged such that they can be moved into and out from the press body simultaneously with the movement of the moving bolsters without causing any interference with uprights of the press. Therefore, workpiece gripping finger units attached to approximately central parts of the transfer bars can be moved together with the transfer bars outside the press body, and therefore they can be replaced easily and rapidly. Whilst, workpiece rests mounted in the workpiece carrying-in and -out portions and idle stations defined between adjacent moving bolsters and finger units attached to the transfer bars located above the said portions and stations interfere with the upright of the press, and therefore cannot be moved together with the moving bolsters outside the press body. Therefore, when replacements of the workpiece rests or the finger units are made, it is necessary for the operator to enter the press body to make such replacement operations manually. This brings forth a lowering in the efficiency of replacement operations and is dangerous for the operator.

SUMMARY OF THE INVENTION

The present invention has been made in view of the ahove-mentioned circumstances and has for its object to provide a transfer press wherein when moving bolsters are moved into and out from the press body, workpiece gripping finger units respectively mounted in workpiece carrying-in and -out portions and idle stations defined between the adjacent moving bolsters can be automatically moved to a position where each of the finger units does not interfere with the uprights of the press so that replacements of fingers of the finger unit can be made readily and safely in a short time.

Another object of the present invention is to provide a transfer press wherein when moving bolsters are moved into and out from the press body, workpiece rests respectively mounted in workpiece carrying-in and -out portions and idle stations defined between the adjacent moving bolsters can be automatically moved to a position where each of the workpiece rests does not interfere with the uprights of the press so that replacements of workpiece receiving arms of the workpiece rest can be made readily and safely in a short time.

A still further object of the present invention is to provide a transfer press wherein the finger unit can be rigidly secured to the transfer bar.

To achieve the above-mentioned objects, according to the present invention, there is provided a transfer press comprising workpiece gripping finger units respectively mounted in a workpiece carrying-in portion and a workpiece carrying-out portion and idle stations defined between adjacent moving bolsters, each of said finger units being mounted turnably up and down on central transfer bars each of which is mounted substantially above said individual moving bolsters and between intermediate bars and which can be freely moved into and out from the press body without causing any interference with uprights of the press.

Further, according to the present invention, there is provided a transfer press comprising workpiece gripping finger units respectively mounted in workpiece carrying-in and -out portions and idle stations defined between adjacent moving bolsters, each of said finger units being mounted turnably up and down on central tranfer bars each of which is mounted substantially above said individual moving bolsters and between intermediate bars and which can be freely moved into and out from the press body without causing any interference with uprights of the press; and workpiece rests respectively mounted in the workpiece carrying-in and -out portions and idle stations defined between adjacent moving bolsters, each of said workpiece rests being mounted turnably about its own axis on the respective end faces of said individual moving bolsters on the side of conveyance of workpiece so that each of said workpiece rests can be moved into and out from the press body together with said moving bolsters without interfering with the uprights.

Further, according to the present invention, there is provided a transfer press characterized in that said finger unit comprises approximately L-shaped turning arms pivotally mounted through pivot shafts on the outside surfaces of respective end portions of said central transfer bars, upper members each being integrally connected to each of said turning arms and having a finger attached to the leading end thereof, and turnihg means respectively adapted to turn said turning arms up and down relative to said central transfer bars.

Still further, according to the present invention, there is provided a transfer press characterized in that each of said turning means comprises an actuator means mounted on the outside surface of the end portion of said central transfer bar, a rack means connected to an actuating rod of the actuator means so as to be reciprocated freely in the longitudinal direction of the transfer bar, and a pinion means fixedly secured to said pivot shaft so as to be meshed with the rack means.

Moreover, according to the present invention, there is provided a transfer press characterized in that said finger is attached to the leading end of the upper member of said turning arm by the interposition of a mounting member integrally connected to the leading end of the upper member and extending along the upper surface of said intermediate bar and in the longitudinal direction thereof.

Further, according to the present invention, there is provided a transfer press characterized in that said mounting member has at the leading end thereof an engaging portion formed as a slope where is gradually inclined to be lowered towards the leading end thereof, and the transfer press further comprises an engaging means mounted on the upper surface of said intermediate bar so as to engage with and disengage from the engaging portion of said mounting member.

Still further, according to the present invention, there is provided a transfer press characterized in that said engaging neans comprises an actuating cylinder means mounted on the upper surface of said intermediate bar, and an engaging member whose trailing end is connected to an actuating rod of the actuating cylinder means so as to be reciprocated through a guide in the longitudinal direction of said intermediate bar and whose leading end has an engaging portion formed as a slope where is gradually inclined reversely to the slope of the engaging portion of said mounting member.

Further, according to the present invention, there is provided a transfer press characterized in that said finger is attached through a mounting plate having a workpiece gripper in the central part thereof to said mounting member.

Still further, according to the present invention, there is provided a transfer press characterized in that each of said workpiece rests comprises a plurality of support rests each mounted turnably about its axis on the said respective end face of the moving bolster; turning means respectively connected to said support rests so as to turn the latter; stands fixedly secured to said support rests, respectively, and extending substantially in the vertical direction; and workpiece receiving arms detachably mounted on the upper parts of said stands, respectively, and extending substantiailly in the horizontal direction.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
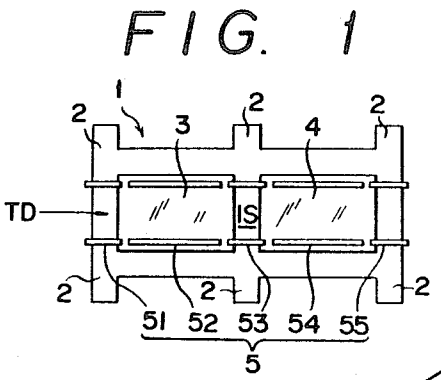
FIG. 1 is a schematic plan view of the upper surface of a bed of a transfer press according to one embodiment of the present invention.
Figure 2:
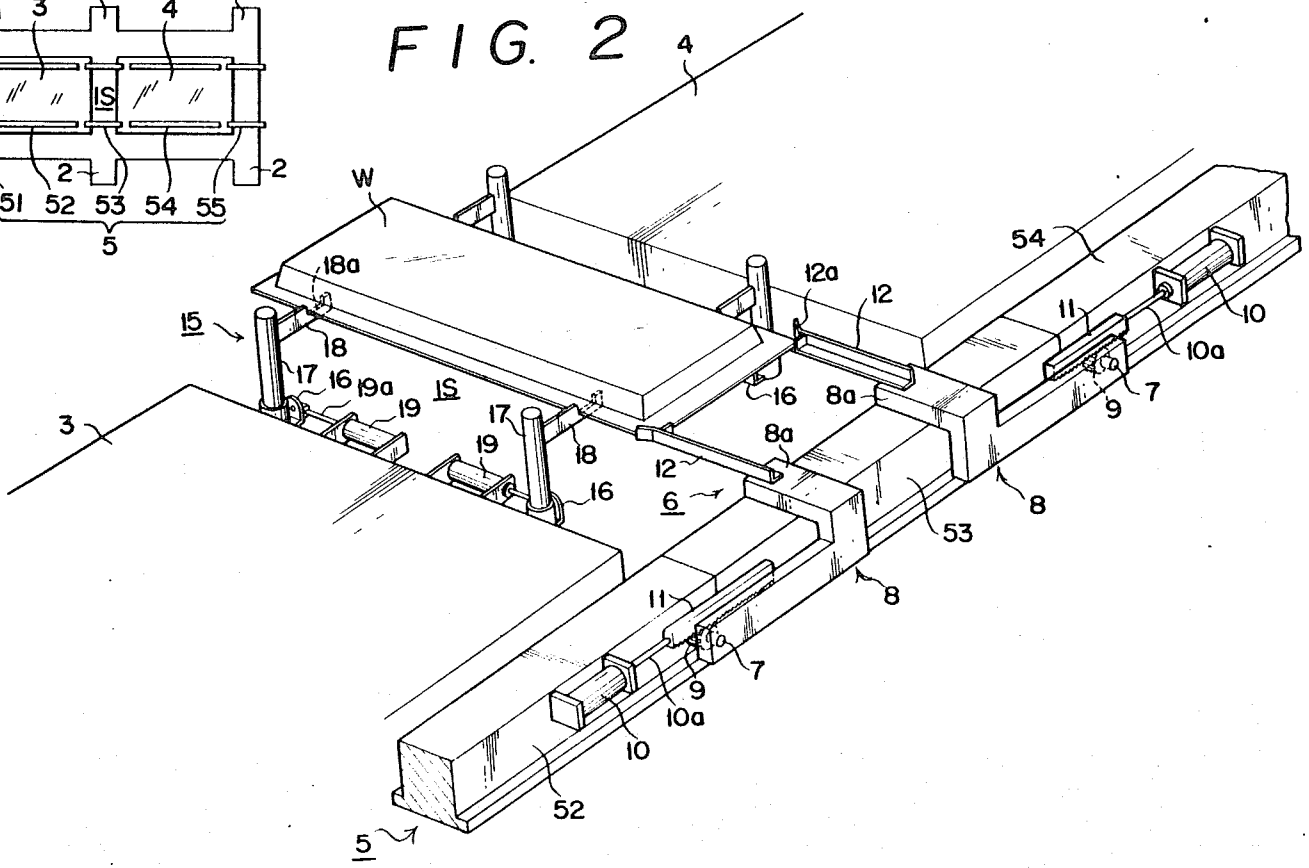
FIG. 2 is a schematic perspective view of the main part of a transfer press according to one embodiment of the present invention.

In FIGS. 1 and 2, reference numeral 1 denotes a three-uprights type transfer press body wherein two sets of moving bolsters 3, 4 are mounted between uprights 2 so as to be freely moved into the press body and out therefrom. Juxtaposed above the moving bolsters 3, 4 along the direction of conveyance (shown by arrow TD) of a workpiece W are two transfer bars 5. Each of the transfer bars 5 comprises central bars 52 and 54 divided correspondingly to the moving bolsters 3 and 4, an upstream bar 51 mounted on a workpiece carrying-in portion, a downstream bar 55 mounted on a workpiece carrying-out portion, and an intermediate bar 53 mounted between the central bars 52 and 54. Further, an idle station IS is provided between the moving bolsters 3 and 4. A pair of workpiece gripping finger units (hereinafter merely called as finger units) 6,6 are attached to respective end portions of the central bars 52 and 54 adjacent to the idle station IS. Each of the above-mentioned finger units 6,6 comprises approximately L-shaped turning arm 8 whose one end is pivotally mounted on a pivot shaft 7 on the outer surface of the end portion of the central bar 52 or 54. The above-mentioned pivot shaft 7 has a pinion 9 fixedly secured thereto and adapted to be meshed with a rack 11. The rack 11 is adpated to be reciprocated along the outside surface of the transfer bar 5 by an actuator 10 mounted on the outside surface of the central bar 52 or 54. The turning arm 8 has an upper merber 8*a* projecting from the other end thereof and disposed above the intermediate bar 53 at right angles thereto. A finger 12 is detachably mounted on the leading end of the upper member 8*a*. The above-mentioned finger 12 projects from the leading end of the upper member 8*a* of the turning arm 8 disposed opposited towards the idle station IS. The fingers 12 each have a gripping portion 12*a* formed at the leading end thereof and which is adapted to grip a corner of the workpiece W.

Whilst, on the side of the idle station IS between the moving bolsters 3 and 4, there is provided a workpiece rest 15. The above-mentioned workpiece rest 15 has four support rests 16 mounted on the endfaces of the moving bolsters 3 and 4 on the side of conveyance of workpiece so as to be turned freely. Each of the support rests 16 has a cylindrical stand 17 extending vertically from the upper surface thereof. Detachably fitted to the outer periphery of the upper end of each stand 17 is a trailing end of a workpiece receiving arm 18 having a receiving portion 18*a* whose shape is predetermined so as to correspond to the shape of the workpiece W to be supported thereby. Further, pivotally connected to the outer periphery of each of the support rests 16 is the leading end of an actuating rod 19*a* projecting from each of four actuating cylinders 19, two sets on each side, mounted on the end faces of the moving bolsters 3 and 4 on the side of conveyance of workpiece and which are disposed between the support rests 16. The arrangement is made such that each of the stands 17 can be turned about the axis thereof about 90 degrees by means of the actuating cylinder 19 through the support rest 16.

Figure 3:
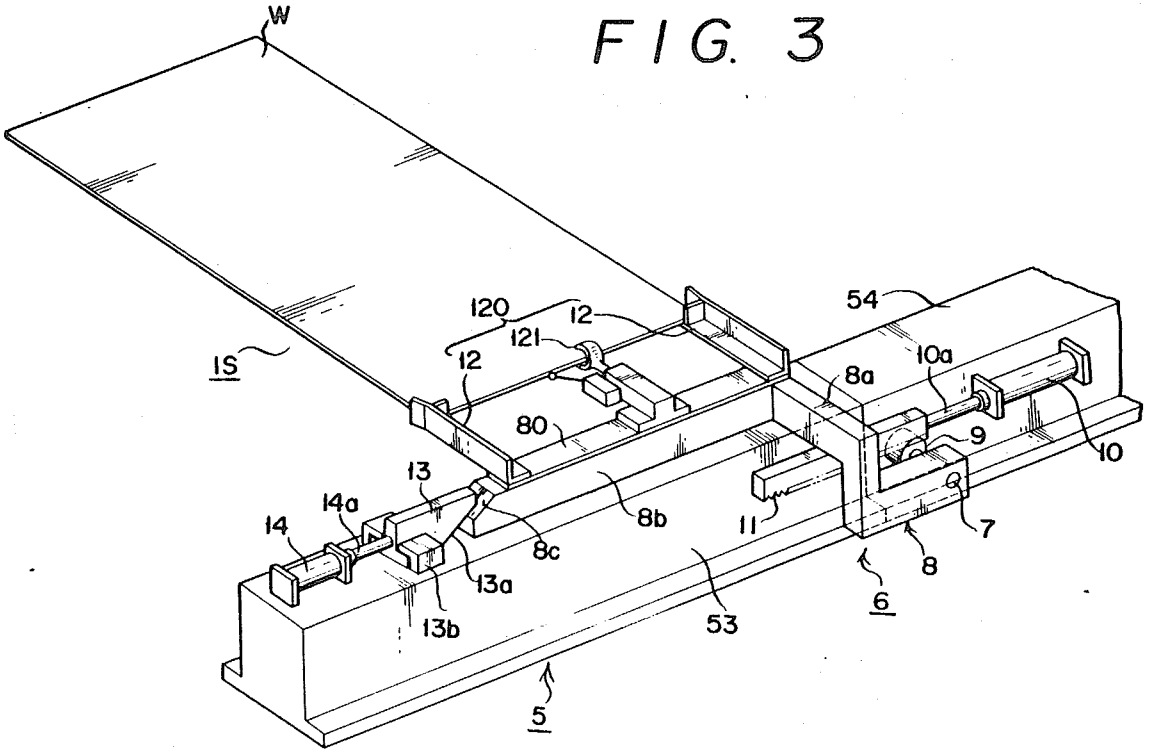
FIG. 3 is a schematic fragmentary perspective view of the main part of a transfer press according to another embodiment of the present invention.

FIG. 3 shows another embodiment of the finger unit according to the present invention. In this embodiment, integrally connected to the leading end of the upper member 8*a* of the turning arm 8 is a mounting member 8*b* extending along the upper surface of the intermediate bar 53 in the longitudinal direction thereof. The mounting member 8*b* has at the leading end thereof an engaging portion 8*c* formed as a slope where is gradually inclined so as to be lowered towards the leading end thereof. Whilst, fixedly secured to the upper surface of the intermediate bar 53 on the other end side is an actuator 14 having an actuating rod 14*a* which has an engaging member 13 fitted to the leading end thereof and adapted to be coupled or engaged with the aforementioned engaging member 8*c*. The engaging member 13 has at the leading end thereof an engaging portion 13*a* formed as a slope where is gradually inclined reversely to the slope of the engaging portion 8*c*. Further, the engaging member 13 is adapted to be reciprocated by an actuator 14 along a guide 13*b* secured to the upper surface of the intermediate bar 53 and in the longitudinal direction thereof so as to engage with and disengage from the mounting member 8*b* of the turning arm 8. Further, a finger set 120 is attached through a mounting plate 80 to the mounting member 8*b* of the turning arm 8. This finger set 120 is comprised of a pair of fingers 12 whose trailing ends are fitted to both ends of the mounting plate 80 and a gripper 121 whose trailing end is fitted to the approximately central part of the mounting plate 80. The turning means for the turning arm 8 employed in this embodiment is the same as that used in the previous embodiment, however, it is not to be limited thereto and any other means which fulfils the same function can be used.

The operation of the aforementioned embodiments will now be described below.

When the moving bolsters 3, 4 are moved outside the press body 1 for the purpose of changing dies, it is only necessary to supply hydraulic pressure into the actuators 10 to disconnect the transfer bar 5 and turn the pinions 9 through the respective racks 11 so as to turn the turning arms 8 about the pivot shafts 7 to dispose the arms to their respective uppermost positions. Consequently, the upper arms 8*a* of turning arms 8 and the fingers 12 or the finger set 120 attached to the leading end thereof will be moved from the end face portions of the central bars 52, 54 towards their respective central portions. Thus, when the moving bolsters 3, 4 are drawn out, the respective turning arms 8 of the pair of finger units 6 and the fingers 12 or the finger set 120 will be moved to their respective uppermost positions where they do not interfere with the uprights 2. In consequence, the fingers 12 are pulled outside the press body 1 together withdhe moving bolsters 3 and 4 and central bars 52 and 54. Further, after change of dies and replacements of the fingers are made, the moving bolsters 3 and 4 are again moved into the press body 1, and then the transfer bars 5 are connected, and also the turning arms 8 are turned by the respective actuators 10 back to their original positions through the action of the respective racks 11 and pinions 9.

In case the moving bolsters are pulled out from within the press body as in the case of the finger unit 6, the aforementioned workpiece rest 15 is operated as mentioned below.

Stating briefly, when all the stands 17 are turned by the action of the actuating cylinders 19 through the support rests 16 so as to locate the leading ends of the workpiece receiving arms 18 opposite to each other, the workpiece receiving arms 17 are moved to the location where they do not interfere with the uprights 2 so that the workpiece rest 15 may be pulled outside the press body 1 together with the moving bolsters 3 and 4. Thus, it becomes possible to replace the workpiece receiving arms 18 of the workpiece rest 15 outside the press body. Further, when the moving bolsters 3 and 4 have been moved into the press body after completion of replacements of dies and workpiece receiving arms 18, the support rests 16 are turned again by the actuating cylinders 19 to turn the stands 17 so as to direct the leading ends of the workpiece recieiving arms 18 to the idle station IS.

It is to be understood that the foregoing description is merely illustrative of the preferred embodiments of the invention and that the invention is not to be limited thereto, but is to be determined by the scope of the appended claims.

What I claim is:

1. A transfer press comprising workpiece gripping finger units mounted in idle stations between adjacent moving bolsters, said finger units being pivotally mounted on central transfer bars substantially above said individual moving bolsters and between intermediate bars for pivotal movement about an axis on said central transfer bars for pivotally moving said finger units into an upward vertical position above said central transfer bars for movement into and out from the press body together with said bolsters and for pivotally moving said finger units into horizontal position above said intermediate bars when said bolsters and said transfer bars are in said press, said finger units each comprising an approximately L-shaped turning arm pivotally mounted through a pivot shaft on the outside surface of respective end portions of said central transfer bars, an upper member integrally connected to said turning arm and having at least one finger attached to the leading end thereof, and turning means for turning said turning arm up and down relative to said central transfer bars, said at least one finger being attached to the leading end of said upper member of said turning arm by a mounting member integrally connected to the leading end of said upper member and extending along the upper surface of said intermediate bar and in the longitudinal direction thereof.

2. A transfer press as claimed in claim 1 wherein each of said turning means comprises an actuator means mounted on the outside surface of the end portion of said central transfer bar, a rack means connected to an actuating rod of the actuator means so as to be reciprocated freely in the longitudinal direction of the transfer bar, and a pinion means fixedly secured to said pivot shaft so as to be meshed with the rack means.

3. A transfer press as claimed in claim 1 wherein said mounting member has at the leading end thereof an engaging portion formed as a slope where is gradually inclined to be lowered towards the leading end thereof, and further comprising an engaging means mounted on the upper surface of said intermediate bar so as to engage with and disengage from the engaging portion of said mounting member.

4. A transfer press as claimed in claim 3 wherein said engaging means comprises an actuating cylinder means mounted on the upper surface of said intermediate bar, and an engaging member whose trailing end is connected to an actuating rod of said actuating cylinder means so as to be reciprocated through a guide in the longitudinal direction of said intermediate bar and whose leading end has an engaging portion formed as a slope where is gradually inclined reversely to the slope of the engaging portion of said mounting member.

5. A transfer press as claimed in claim 1 wherein said at least one finger is attached through a mounting plate having a workpiece gripper in the central part thereof to said mounting member.

6. A transfer press comprising workpiece gripping finger units mounted in an idle station between adjacent moving bolsters, each of said finger units being pivotally mounted on central transfer bars substantially above said individual moving bolsters and between intermediate bars and being pivotal about an axis on said central transfer bars for pivotally moving said finger units into an upward vertical position above said central transfer bars for movement into and out from the press body together with said bolsters and for pivotally moving said finger units into horizontal position above said intermediate bars when said bolsters and said transfer bars are in said press, and workpiece rests mounted between adjacent moving bolsters, each of said workpiece rests being mounted turnably about an axis on the respective end faces of said individual moving bolsters on ths side of conveyance of workpiece so that each of said workpiece rests can be moved into and out from the press body together with said moving bolsters, said each of said finger units comprising an approximately L-shaped turning arm pivotally mounted through pivot shafts on outside surfaces of respective end portions of said central transfer bars, an upper member each being integrally connected to each of said turning arms and having at least one finger attached to the leading end thereof, and first turning means respectively for turning said turning arms up and down relative to said central transfer bars, said workpiece rests comprising a plurality of support rests each mounted turnably about its axis on the said respective end face of the moving bolster; second turning means connected to each of said support rests for turning said each of said support rests; stands fixedly secured to each of said support rests and extending substantially in the vertical direction; and workpiece receiving arms detachably mounted on the upper parts of each of said stands and extending substantially in the horizontal direction.

7. A transfer press as claimed in claim 6 wherein each of said first turning means comprises an actuator means mounted on the outside surface of one end portion of said central transfer bar, a rack means connected with an actuating rod of the actuator means so as to be reciprocated freely in the longitudinal direction of the transfer bar, and a pinion means fixedly secured to said pivot shaft so as to be meshed with the rack means.

8. A transfer press as claimed in claim 7 wherein said at least one finger is attached to the leading end of the upper member of said turning arm by the interposition of a mounting member integrally connected to the leading end of the upper member and extending along the upper surface of said intermediate bar and in the longitudinal direction thereof.

9. A transfer press as claimed in claim 8 wherein said mounting member has at the leading end thereof an engaging portion sloped gradually towards the leading end thereof, and further comprising an engaging means mounted on the upper surface of said intermediate bar to engage with and disengage from said engaging portion.

10. A transfer press as claimed in claim 9 wherein said engaging means comprises an actuating cylinder means mounted on the upper surface of said intermediate bar, said actuating cylinder means having an acutating rod and an engaging means connected to said actuating rod for reciprocation in the longitudinal direction of said intermediate bar said engaging means having a leading end with a sloped engaging portion inclined reversely to the slope of the engaging portion of the mounting member.

11. A transfer press as claimed in claim 8 wherein said at least one finger is attached through a mounting plate having a workpiece gripper in the central part thereof to said mounting member.

* * * * *